US007631385B2

(12) United States Patent
Schouten

(10) Patent No.: US 7,631,385 B2
(45) Date of Patent: Dec. 15, 2009

(54) AUTOMOTIVE CLEANING DEVICE

(75) Inventor: Pieter Schouten, Berkeley, CA (US)

(73) Assignee: Carrand Companies, Inc., Compton, CA (US)

( * ) Notice: Subject to any disclaimer, the term of this patent is extended or adjusted under 35 U.S.C. 154(b) by 806 days.

(21) Appl. No.: 11/421,520

(22) Filed: Jun. 1, 2006

(65) Prior Publication Data

US 2008/0104779 A1 May 8, 2008

(51) Int. Cl.
*A46B 9/02* (2006.01)
*A46B 13/02* (2006.01)

(52) U.S. Cl. ..... 15/21.1; 15/160; 15/206

(58) Field of Classification Search ..... 15/21.1, 15/160, 164, 206; D4/119, 120, 128
See application file for complete search history.

(56) References Cited

U.S. PATENT DOCUMENTS

| | | | | | |
|---|---|---|---|---|---|
| 640,190 | A | * | 1/1900 | Fradenburg | 15/104.068 |
| 1,588,940 | A | * | 6/1926 | Cave | 15/206 |
| 2,186,832 | A | * | 1/1940 | Hertzberg | 15/114 |
| 2,631,316 | A | * | 3/1953 | Heller | 15/106 |
| 2,675,572 | A | * | 4/1954 | Nomiya | 15/164 |
| D213,066 | S | * | 12/1968 | Wright | D32/33 |
| 3,760,449 | A | * | 9/1973 | Swanson | 15/206 |
| 4,117,566 | A | | 10/1978 | Ward | |
| 4,120,068 | A | | 10/1978 | Kaczmarek | |
| 4,756,044 | A | | 7/1988 | Clark | |
| 5,123,763 | A | | 6/1992 | Simmons | |
| 5,257,435 | A | * | 11/1993 | Brewster | 15/179 |
| 6,067,686 | A | | 5/2000 | Gronkiewicz | |
| 6,470,526 | B2 | | 10/2002 | Large | |
| D465,929 | S | * | 11/2002 | Thomas et al. | D4/120 |
| 6,754,932 | B2 | | 6/2004 | Buzard | |
| 2005/0172437 | A1 | | 8/2005 | Wachter | |

FOREIGN PATENT DOCUMENTS

| | | |
|---|---|---|
| JP | 07-322919 | * 12/1995 |

* cited by examiner

*Primary Examiner*—Randall Chin
(74) *Attorney, Agent, or Firm*—George R. McGuire; Bond Schoeneck & King, PLLC

(57) ABSTRACT

The present invention is directed to an automotive cleaning device that includes an elongated base member having a first end and a second end. A brush assembly is connected to the second end. The brush assembly includes three brush members connected to the base member at the second end. Each of the brush members includes a wire element having fill bristles attached thereto. The wire element is connected to the second end at a first terminating point and a second terminating point with a looped wire portion extending therebetween. The looped wire portions of the three brush members are disposed on the base member to thereby form a brush gap configured to accommodate a wheel lug nut.

18 Claims, 1 Drawing Sheet

AUTOMOTIVE CLEANING DEVICE

BACKGROUND OF THE INVENTION

1. Field of the Invention

The present invention relates generally to an automotive cleaning device, and particularly to a vehicle lug nut cleaning device.

2. Technical Background

The wheels of automobiles, trucks, SUVs, and other such vehicles are typically equipped with hub caps that cover at least a portion of the wheel rim. Certain types of hub caps include receptacles that receive and cover the wheel lug nuts. The lug nut receptacles form crevices in the hub cap which tend to collect dirt and road grime. On the other hand, the wheels may be disposed on the vehicle such that the lug nuts are exposed to the ambient conditions. Of course, when vehicle wheels are exposed to the ambient road conditions, the lug nuts may become dirty and rusted.

The process of cleaning lug nuts and/or lug nut receptacles may be difficult and laborious because of the cracks and crevices in the and around these features. The lack of clearance prevents the cleaner from accessing these areas. For example, the tight clearances prevents conventional brushes or a person's fingers from entering these spaces to remove dirt, rust and grime.

In one approach that may be considered, the vehicle owner may remove the wheel from the vehicle for cleaning. By removing the wheel, the vehicle owner may clean each lug nut separately. Of course, as those skilled in the art will appreciate, this process is time consuming and laborious. The car must be placed on a jack-stand and elevated. After each of the lugs are removed, the tire is lifted off of the wheel. After cleaning the lugs, the process is reversed.

In another approach that has been considered, a sponge may be employed to clean the vehicle lug nuts. However, sponges do not have the rigidity to penetrate into cracks and crevices. Further, sponges have a tendency have wearing out and disintegrating after being repeatedly applied to irregular metallic surfaces.

Accordingly, what is needed is a durable lug cleaning implement that overcomes the deficiencies described above.

SUMMARY OF THE INVENTION

One aspect of the present invention is directed to an automotive cleaning device that includes an elongated base member having a first end and a second end. A brush assembly is connected to the second end. The brush assembly includes three brush members connected to the base member at the second end. Each of the brush members includes a wire element having fill bristles attached thereto. The wire element is connected to the second end at a first terminating point and a second terminating point with a looped wire portion extending therebetween. The looped wire portions of the three brush members are disposed on the base member to thereby form a brush gap configured to accommodate a wheel lug nut.

In another aspect, the present invention is directed to an automotive cleaning system that includes an electrically powered tool including a connector portion configured to rotate about an axis of rotation when the tool is in an energized state. A cleaning device including an elongated base member having a first end and a second end. The first end is configured to accommodate the connector portion such that the cleaning device rotates about the axis of rotation when the tool is in the energized state. The cleaning device also includes a brush assembly connected to the second end. The brush assembly includes three brush members connected to the base member at the second end. Each of the brush members includes a wire element having fill bristles attached thereto. The wire element is connected to the second end at a first terminating point and a second terminating point with a looped wire portion extending therebetween. The looped wire portions of the three brush members are disposed on the base member to thereby form a brush gap configured to accommodate a wheel lug nut.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
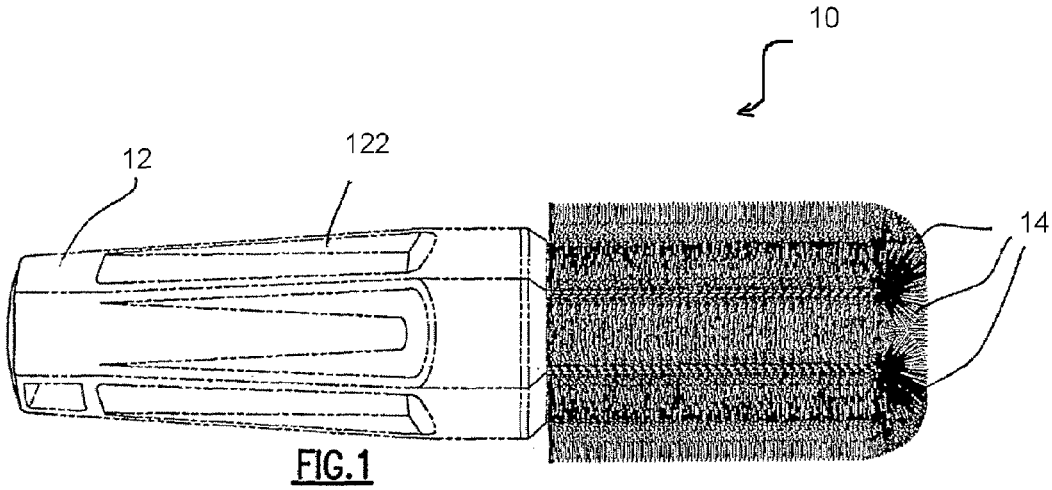
FIG. 1 is a first side elevation view of a lug nut brush in accordance with the present invention.

Reference will now be made in detail to the present embodiments of the invention, examples of which are illustrated in the accompanying drawings. Wherever possible, the same reference numbers will be used throughout the drawings to refer to the same or like parts. An exemplary embodiment of the lug nut brush of the present invention is shown in FIG. 1, and is designated generally throughout by reference numeral 10.

Figure 2:
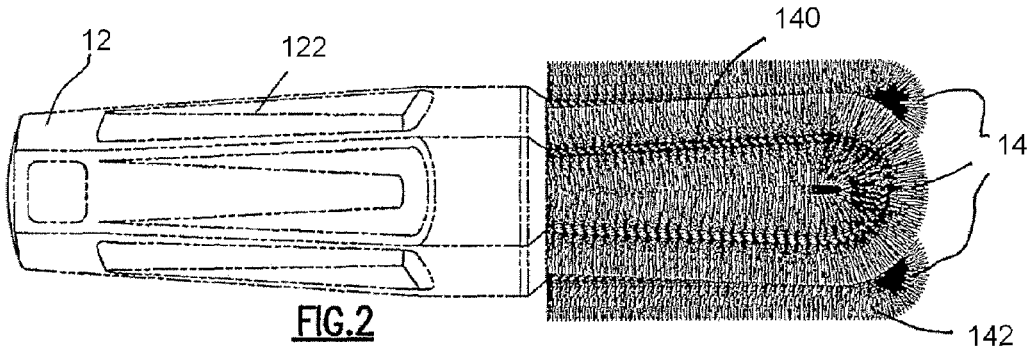
FIG. 2 is a second side elevation view of the lug nut brush shown in FIG. 1.
Figure 3:
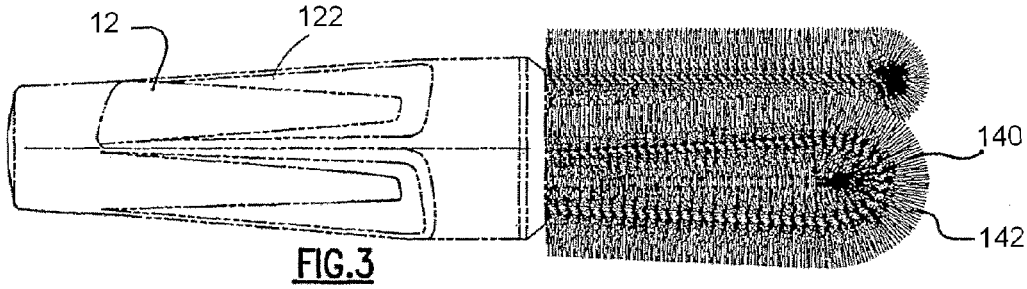
FIG. 3 is a third side elevation view of the lug nut brush shown in FIG. 1.

Referring to FIGS. 1-3, various side elevation views of a lug nut brush 10 in accordance with the present invention are disclosed. Brush 10 includes an elongated tapered base member 12 integrally connected to three brush members 14. Base member 12 may be hand held in use, or may be attached to a rotating power tool. In one embodiment, the base member is fabricated from a hard plastic material. Base member 12 includes a gripping portion 122. Each brush 14 consists of a wire element 140 and brush bristles 142. A portion of the wire element 140 is disposed and encapsulated in the plastic base member 12 to thereby secure the brush member 14 to the base 12. In one embodiment wire element 140 is formed as a loop, with a lower portion of the loop encapsulated in the plastic base member.

Those of ordinary skill in the art will understand that brushes 14 may be of any suitable type. For example, brush wire element 140 may be constructed using two stem wires. Brush bristles 142 may be twisted between the two stem wires. The stem wires are terminated in the base member 12.

On the other hand, the bristles 142 may be twisted between four stem wires. This is known in the art as a single spiral/double stem brush. Of course, the present invention contemplates using a double spiral/double stem arrangement as well. IN this arrangement, two layers of fill bristles are twisted between the four stem wires comprising the wire element 140.

Figure 4:
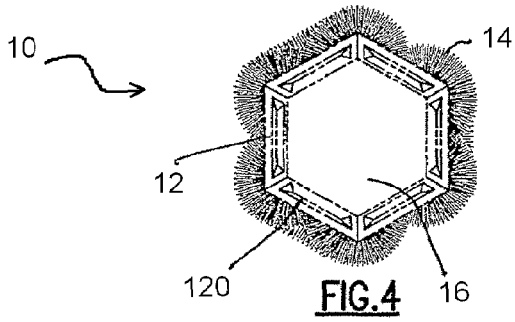
FIG. 4 is a top view of the lug nut brush shown in FIG. 1.

Referring to FIG. 4, a bottom view of the lug nut brush shown in FIG. 1 is disclosed. FIG. 4 reveals that base member 12 has a hexagonal shaped cross-section. Base member 12 is hollow and includes a hex-shaped hole 16 configured to accommodate a hex lug-nut. This feature is advantageous because it allows the user to adjust the position of the lug nut along the wheel stud. Once adjusted, the wire brush portion 14 may be used to clean the space between the lug nut and the wheel. Alternatively, brush 14 may remove any dirt or rust that has accumulated on, or between, the threads of the stud.

Figure 5:
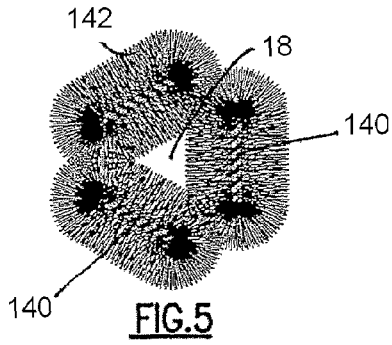
FIG. 5 is a bottom view of the lug nut brush shown in FIG. 1.

FIG. 5 is a top view of the lug nut brush shown in FIG. 1. The three brushes 14 form a space 18 for accommodating a lug nut. In operation, the user inserts the lug nut into space 18 and rotates the base member 12. Dirt and rust are removed by the brushes 14 as they are rotated around the lug nut. The edges of the brushes 14 may also be used to remove foreign materials from the lugs or other portions of the wheel. For example, when the lugs are rotated such that a portion of a stud is exposed near the wheel, the edge of the brush may be applied to remove rust and/or dirt.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. An automotive cleaning device comprising:

an elongated base member having a first end, second end and a longitudinal axis; and a brush assembly connected to the second end, the brush assembly including at least three brush members connected to the base member at the second end, each of the brush members including a wire element having fill bristles attached thereto, the wire element being connected to the second end at a first terminating point and a second terminating point with a looped wire portion extending therebetween, the looped wire portions of the at least three brush members being disposed on the base member and extending in a direction substantially parallel to the longitudinal axis of the elongated base member to thereby form a brush gap configured to accommodate a wheel lug nut.

2. The device of claim 1, wherein the base member includes six walls such that the base member is characterized by a hexagonal cross-section.

3. The device of claim 2, wherein each of the at least three brush members are connected to alternating walls of the base member at the second end.

4. The device of claim 3, wherein the looped wire portions of the at least three brush members form the brush gap, the brush gap being of a triangular shape.

5. The device of claim 1, wherein the first end of the base member is configured to accommodate a hex-lug nut.

6. The device of claim 1, wherein the base member is comprised of a plastic material.

7. The device of claim 1, wherein the base member is comprised of a metallic material.

8. The device of claim 1, wherein the base member includes a gripping portion disposed on an outer surface thereof.

9. The device of claim 1, wherein the brush gap is of a triangular shape.

10. The device of claim 1, wherein each wire element is formed as a continuous loop, a first portion of the continuous loop being encapsulated with a wall of the base member.

11. The device of claim 10, wherein the continuous loop includes a second portion having the bristles connected thereto.

12. The device of claim 1, wherein each wire element includes two stem wires twisted together, the fill bristles being disposed between the two stem wires.

13. The device of claim 1, wherein each wire element includes four stem wires twisted together, the fill bristles being disposed between the four stem wires.

14. The device of claim 13, wherein each brush member is configured as a double stem single spiral brush.

15. The device of claim 13, wherein each brush member is configured as a double stem double spiral brush.

16. The device of claim 1, wherein the first end of the base member is configured to accommodate a tool attachment device.

17. An automotive cleaning system comprising:

an electrically powered tool including a connector portion configured to rotate about an axis of rotation when the tool is in an energized state; and a cleaning device including an elongated base member having a first end, a second end and a longitudinal axis, the first end being configured to accommodate the connector portion such that the cleaning device rotates about the axis of rotation when the tool is in the energized state, the cleaning device also including a brush assembly connected to the second end, the brush assembly including at least three brush members connected to the base member at the second end, each of the brush members including a wire element having fill bristles attached thereto, the wire element being connected to the second end at a first terminating point and a second terminating point with a looped wire portion extending therebetween, the looped wire portions of the at least three brush members being disposed on the base member and extending in a direction substantially parallel to the longitudinal axis of the elongated base member to thereby form a brush gap configured to accommodate a wheel lug nut.

18. The system of claim 17, wherein the cleaning device may be employed by hand when detached from the electrically powered tool.

* * * * *